US008876278B2

(12) United States Patent
Kobayashi

(10) Patent No.: US 8,876,278 B2
(45) Date of Patent: Nov. 4, 2014

(54) RECORDING APPARATUS

(75) Inventor: Yoichi Kobayashi, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 69 days.

(21) Appl. No.: 13/198,098

(22) Filed: Aug. 4, 2011

(65) Prior Publication Data

US 2012/0044308 A1 Feb. 23, 2012

(30) Foreign Application Priority Data

Aug. 19, 2010 (JP) ..... 2010-183716

(51) Int. Cl.

| | |
|---|---|
| ***B41J 2/01*** | (2006.01) |
| ***B41J 2/17*** | (2006.01) |
| ***B41J 11/00*** | (2006.01) |
| ***B41J 11/06*** | (2006.01) |

(52) U.S. Cl.

CPC ..... *B41J 2/1721* (2013.01); *B41J 11/0085* (2013.01); *B41J 11/06* (2013.01); *B41J 2002/1742* (2013.01); *B41J 11/0065* (2013.01)

USPC ..... 347/104; 347/5; 347/9; 347/14; 347/16; 347/101

(58) Field of Classification Search

None

See application file for complete search history.

(56) References Cited

U.S. PATENT DOCUMENTS

| | | | | |
|---|---|---|---|---|
| 6,239,817 | B1 | 5/2001 | Meyer | |
| 6,651,974 | B2 * | 11/2003 | Kawarama et al. | 271/121 |
| 7,018,009 | B2 * | 3/2006 | Isono et al. | 347/16 |
| 7,040,825 | B2 * | 5/2006 | Asada et al. | 400/656 |
| 7,144,106 | B2 * | 12/2006 | Ishii et al. | 347/104 |
| 7,896,486 | B2 * | 3/2011 | Sugahara | 347/102 |
| 2004/0183846 | A1 | 9/2004 | Kunihiro | |
| 2006/0125862 | A1 | 6/2006 | Nunokawa | |
| 2009/0262174 | A1 * | 10/2009 | Toyoshima | 347/104 |

FOREIGN PATENT DOCUMENTS

| | | |
|---|---|---|
| JP | 2000-118058 | 4/2000 |
| JP | 2004-230817 | 8/2004 |
| JP | 2007-331243 | 12/2007 |
| JP | 2010-000694 | 1/2010 |
| JP | 2010-082835 | 4/2010 |
| JP | 2010-137399 | 6/2010 |
| WO | 2004-071774 | 8/2004 |

* cited by examiner

*Primary Examiner* — Manish S Shah

*Assistant Examiner* — Jeremy Delozier

(74) *Attorney, Agent, or Firm* — Workman Nydegger

(57) ABSTRACT

A recording apparatus includes a recording head that ejects a liquid thereby performing recording on a recording medium, and a support member disposed so as to oppose the recording head. The support member includes a deposit recess located at a position corresponding to the respective end portion of the recording medium in the width direction intersecting with the transport direction, for receiving the liquid ejected to a region deviated from the recording medium in a marginless recording process, and a support region provided upstream of the deposit recess in the transport direction so as to support a back surface of the recording medium, and most upstream nozzles in the transport direction are not used in the marginless recording process.

5 Claims, 3 Drawing Sheets

RECORDING APPARATUS

The entire disclosure of Japanese Patent Application No: 2010-183716, filed Aug. 19, 2010 is expressly incorporated by reference herein.

BACKGROUND

1. Technical Field

The present invention relates to a recording apparatus such as an ink jet printer.

2. Related Art

In the field of recording apparatuses, a printer is known that includes a recording head and a support member (platen) incorporated with a suction mechanism, and ejects a liquid (ink) from the recording head onto a recording medium (paper) while sucking the paper onto the support member by the suction mechanism, thereby recording data on the paper, for example as disclosed in JP-A-2010-694.

The platen according to the JP-A-2010-694 includes, in the paper passage surface thereof, an adsorption recess for adsorbing the paper and a recess for marginless recording for receiving ink droplets deviating from the paper when performing a marginless recording process. The adsorption recess serves to retain the paper in a flat state, and is hence located at a position corresponding to a recording region where the recording head ejects the ink for recording data on the paper. The recess for marginless recording is located at a position corresponding to an edge of the paper.

The printer according to JP-A-2010-694 includes a pair of transport rollers located upstream of the platen in a direction in which the paper is transported (hereinafter, transport direction) that serve to transport the paper to the platen. The pair of transport rollers pinch the paper therebetween so as to press the paper against the platen, thus keeping the paper from floating upward from the paper passage surface. Accordingly, it is preferable to make the distance between the pair of transport rollers and the recording region as short as possible, in order to keep the paper flat so as not to float upward from the paper passage surface.

Here, once the upstream edge of the paper in the transport direction is disengaged from the pair of transport rollers and released toward a downstream side, the pair of transport rollers can no longer maintain the alignment of the paper. Accordingly, an upstream end portion of the paper in the transport direction between the upstream edge and a position pressed against the platen at the moment that the upstream edge is released from the rollers may be regarded as a margin where recording is not performed. Therefore, a longer distance between the pair of transport rollers and the recording region makes the recordable region on the paper smaller. Thus, from the viewpoint of securing a larger recordable region of the paper also, it is preferable to make the distance between the pair of transport rollers and the recording region as short as possible.

On the other hand, a support surface that presses the paper against the platen has to be provided upstream of the paper passage surface in the transport direction, and the space for providing such a support surface inevitably increases the distance between the pair of transport rollers and the recording region. Also, the recess for marginless recording has to be made longer in the transport direction than the recording region on the paper, in order to receive the ink droplets deviating from the paper. In the paper passage surface of the printer according to JP-A-2010-694, therefore, the support surface for pressing the paper is not provided upstream of the recess for marginless recording in the transport direction, but provided only upstream of the adsorption recess, so that the distance between the pair of transport rollers and the recording region becomes smaller.

With such a configuration, however, the end portions of the paper in a width direction intersecting with the transport direction freely float above the recess for marginless recording. Accordingly, the end portions of the paper exhibit different degrees of distortional deformation depending on the texture, stiffness and so forth of the paper, which makes it difficult to stabilize the alignment of the paper. The failure to stabilize the alignment of the paper leads to deviated landing positions of ink droplets in a recording process, resulting in degraded printing quality.

SUMMARY

An advantage of some aspects of the invention is that a recording apparatus is provided that can stabilize the alignment of a recording medium on a support member, thereby preventing degradation of recording quality.

In an aspect, the invention provides a recording apparatus including a pair of transport rollers that transport a recording medium in a transport direction; a recording head that ejects a liquid through a plurality of nozzles arranged in a row in the transport direction to a front surface of the recording medium being transported by the pair of transport rollers, thereby performing recording on the recording medium; and a support member disposed so as to oppose the recording head, wherein the support member includes a deposit recess that receives the liquid ejected to a region deviated from the recording medium in a marginless recording process in which the record is provided over a region including end portions of the recording medium in a width direction intersecting with the transport direction, the deposit recess being located at a position corresponding to the respective end portion of the recording medium in the width direction, and a support region provided upstream of the deposit recess in the transport direction so as to support a back surface of the recording medium; and the nozzles are arranged in a row on the recording head as far as an upstream position of an upstream end portion of the deposit recess in the transport direction, and a most upstream one of the nozzles in the transport direction is not used in the marginless recording process.

In the recording apparatus thus configured, the support member includes the support region provided on the upstream position of the upstream end portion of the deposit recess in the transport direction, and is hence capable of supporting the recording medium with the support region. Although the nozzles in the recording head are arranged in a row as far as the position upstream of the upstream end portion of the deposit recess in the transport direction, the nozzle located most upstream in the transport direction is not used in the marginless recording process. Such a configuration allows the deposit recess to be made shorter in the transport direction, by a length corresponding to the nozzles that are not used in the marginless recording process. Reducing thus the length of the deposit recess in the transport direction can make the distance between the pair of transport rollers and the recording region shorter, despite the support region being provided upstream of the deposit recess. Consequently, the foregoing recording apparatus can stabilize the alignment of the recording medium on the support member, thereby preventing degradation of recording quality.

In the recording apparatus, preferably, the support member may be incorporated with a suction mechanism that attracts the recording medium, and the support member may include a suction recess through which the attracting force is exerted on the recording medium, and a groove communicating between the deposit recess and the suction recess.

Such a configuration allows the attracting force generated by the suction mechanism to be applied to the deposit recess through the groove, thereby allowing a portion of the recording medium located on the deposit recess to be properly attracted. Accordingly, the end portions of the recording medium on the deposit recess can be suppressed from floating, and the recording medium can be maintained in a stabilized alignment.

In the support member, preferably, the deposit recess may be formed such that the upstream end portion thereof in the transport direction is aligned with an upstream end portion of the suction recess in the transport direction, and the support region may be located upstream of the suction recess in the transport direction.

In this case, since the upstream end portion of the deposit recess in the transport direction is aligned with the upstream end portion of the suction recess in the transport direction, the recording medium can be evenly supported by the support region provided upstream of the deposit recess and the suction recess. Also, air is suppressed from flowing into the deposit recess unlike in a structure in which the upstream end portion of the deposit recess in the transport direction includes a cutaway portion, and therefore the end portion of the recording medium in the width direction can be effectively attracted.

In the support member, preferably, the deposit recess may be formed such that a downstream end portion thereof in the transport direction is located downstream of a downstream end portion of the suction recess in the transport direction, and the support region may be provided so as to surround the deposit recess.

Such a configuration allows the deposit recess to receive the liquid deviating from the recording medium, even though the recording head ejects the liquid through a most downstream nozzle in the transport direction in the marginless recording process. Also, since the support region is provided around the deposit recess, air is suppressed from flowing into the deposit recess unlike in a structure in which the downstream end portion of the deposit recess in the transport direction includes a cutaway portion, and therefore the end portion of the recording medium in the width direction can be effectively attracted.

In the recording apparatus, preferably, the recording head may use all the nozzles from the most upstream one to the most downstream one in the transport direction for performing recording on the recording medium, in a margined recording process in which the recording is performed on the recording medium leaving a margin on the respective end portion thereof in the width direction.

Such an arrangement allows the recording medium to receive the entire liquid ejected through the nozzles in the margined recording process, thereby preventing the support member from being stained despite the recording head ejecting the liquid through the nozzles located upstream of the upstream end portion of the deposit recess.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereafter, an embodiment of an ink jet printer (hereinafter, simply "printer" as the case may be) exemplifying the recording apparatus will be described.

Figure 1:
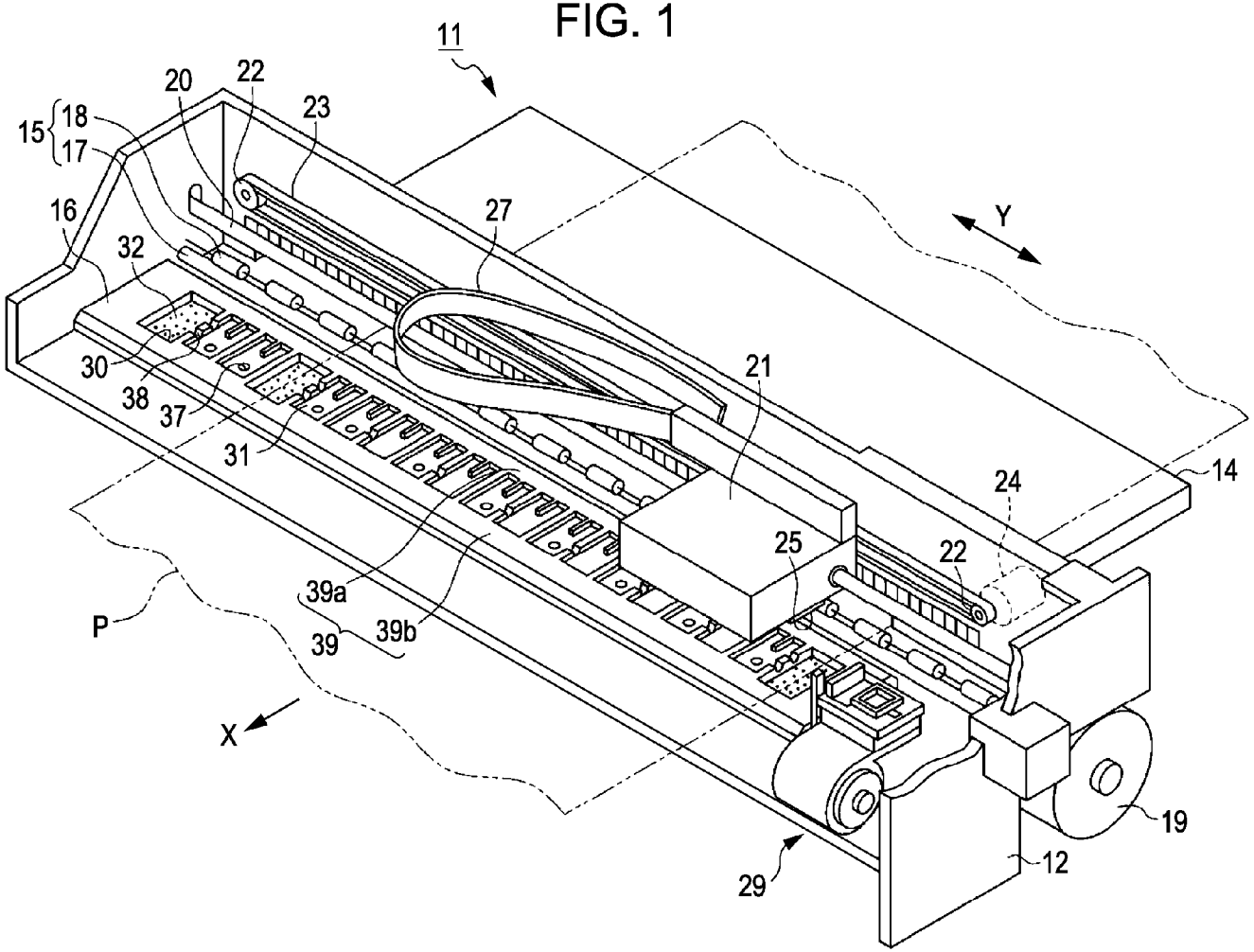
FIG. 1 is a perspective view showing a general configuration of a printer according to an embodiment.

As shown in FIG. 1, the printer 11 includes a generally rectangular box-shaped main body frame 12. A paper feed unit 14 that retains a paper sheet P, exemplifying the recording medium, is provided on a rear side of the main body frame 12. The main body frame 12 includes a pair of transport rollers 15 that transport the paper sheet P retained by the paper feed unit 14 from the rear side of the main body frame 12 toward a front side thereof, in a transport direction X. The main body frame 12 also includes a support member 16 located downstream of the pair of transport rollers 15 in the transport direction X, so as to support the paper sheet P transported by the pair of transport rollers 15.

The pair of transport rollers 15 include a drive roller 17 and a slave roller 18. Also, a transport motor 19 that rotates the drive roller 17 is provided on a right lower portion of the main body frame 12 in FIG. 1. Although not shown, a pair of paper output rollers for discharging the paper sheet P to outside of the main body frame 12 are provided downstream of the support member 16 in the transport direction X. The pair of paper output rollers include a drive roller and a slave roller, the former of which is rotated by the transport motor 19.

The main body frame 12 also includes a guide shaft 20 extending in a width direction Y intersecting with (orthogonal to) the transport direction X so as to form a bridge between left and right sidewalls in FIG. 1. The guide shaft 20 supports a carriage 21 to be made to reciprocate in the width direction Y. A pair of pulleys 22 are attached to an inner surface of a rear wall of the main body frame 12, and an endless timing belt 23 is wound around the pulleys 22. The carriage 21 is fixed to the timing belt 23.

A carriage motor 24 is connected to a drive shaft of the right one of the pulleys 22 in FIG. 1. Alternate rotation of the carriage motor 24 in a forward and reverse direction causes the carriage 21 to reciprocate in the width direction Y through the timing belt 23.

An ink jet recording head 25 is provided on a lower side of the carriage 21, and a plurality of nozzles 26 are arranged in a row in the transport direction X (see FIG. 2A), on a face of the recording head 25 opposing the support member 16 (lower face in FIG. 1).

The recording head 25 is connected to a plurality of ink cartridges (now shown) through a flexible piping plate 27 including a plurality of ink supply tubes bundled, respectively corresponding to different colors. For example, inks of four different colors, black (K), cyan (C), magenta (M), and yellow (Y), are individually supplied by pressure from the respective ink cartridges to the recording head 25.

In the printer 11 thus configured, the recording head 25 ejects an ink, exemplifying the liquid, through the nozzles 26 to a front surface of the paper sheet P transported by the pair of transport rollers 15 so as to be positioned on the support member 16, thereby performing recording (printing) on the paper sheet P. Here, the printer 11 is configured so as to alternately repeat a printing action of ejecting the ink from the recording head 25 to the paper sheet P while causing the carriage 21 to reciprocate in the width direction Y, and a paper feed action of transporting the paper sheet P at a predetermined increment, to thereby record an image or text on the paper sheet P.

In the travel stroke of the carriage 21, the right end position in FIG. 1 serves as a home position where the carriage 21 stands by while recording is not performed. A maintenance unit 29 that performs maintenance jobs for the recording head 25 such as nozzle cleaning is provided at a position corresponding to right under the carriage 21 placed at the home position.

A plurality of deposit recesses 30 and suction recesses 31 are respectively arranged in a row in the width direction Y, on a surface of the support member 16 opposing the recording head 25 (upper surface in FIG. 1). The deposit recesses 30 are each located at a position corresponding to the respective edge of the paper sheet P in the width direction Y. Also, an absorbent 32 that absorbs the ink is accommodated in the deposit recess 30.

Figure 2A:
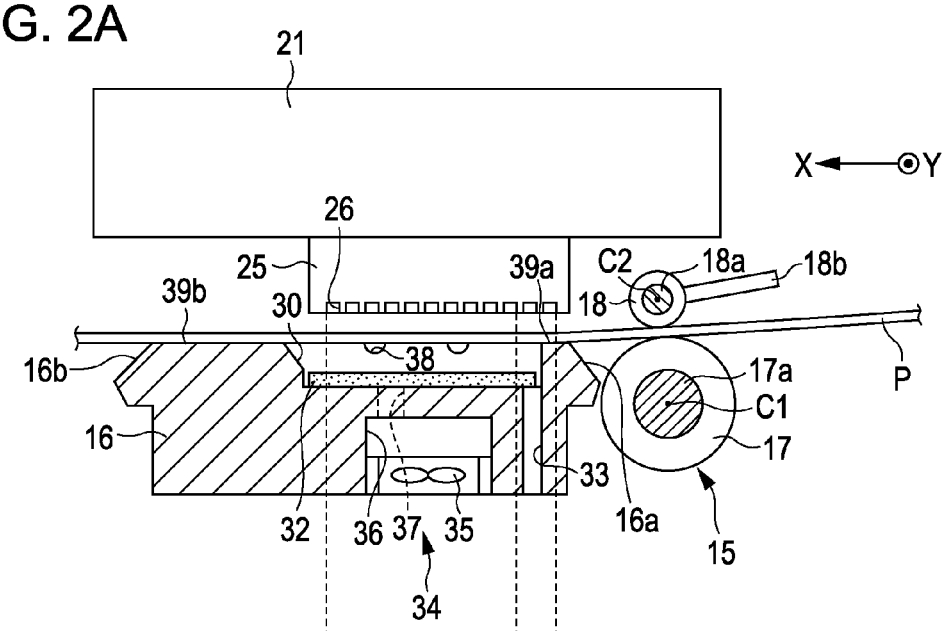
FIG. 2A is a cross-sectional view of a recording head, a pair of transport rollers, and a support member.

Referring now to FIG. 2A, the drive roller 17 is supported by a shaft 17*a*, and the slave roller 18 is supported by a shaft 18*a*. The shaft 18*a* of the slave roller 18 is supported by a support arm 18*b*. The slave roller 18 is positioned by the support arm 18*b* so as to pinch the paper sheet P in collaboration with the drive roller 17.

Here, the axial center C2 of the slave roller 18 is located at a position slightly shifted to the downstream side in the transport direction X from the axial center C1 of the drive roller 17, so that the pair of transport rollers 15 squeeze out the paper sheet P so as to press it against the upper surface of the support member 16. Accordingly, the location and alignment of the paper sheet P on the support member 16 may be considered to be determined by the pair of transport rollers 15.

A guide portion 16*a* that conducts the paper sheet P onto the support member 16 is provided at the upstream end portion of the support member 16 in the transport direction X. Also, a slope portion 16*b* that facilitates the paper sheet P to be smoothly discharged from the support member 16 is provided on a downstream end portion of the support member 16 in the transport direction X. The support member 16 includes a drain path 33 for discharging the deposited ink therethrough, formed at an inner bottom portion of the deposit recess 30. In the recording head 25, the nozzles 26 are provided between a position upstream of the downstream end portion of the deposit recess 30 in the transport direction X and a position upstream of the upstream end portion of the deposit recess 30.

The support member 16 is incorporated with a suction mechanism 34 that attracts the paper sheet P. The suction mechanism 34 includes a suction fan 35 and a negative-pressure chamber 36 from which air is discharged by the suction fan 35. Also, a communication orifice 37 for communication between the negative-pressure chamber 36 and the suction recess 31 is formed through an inner bottom portion of the suction recess 31.

Figure 2B:
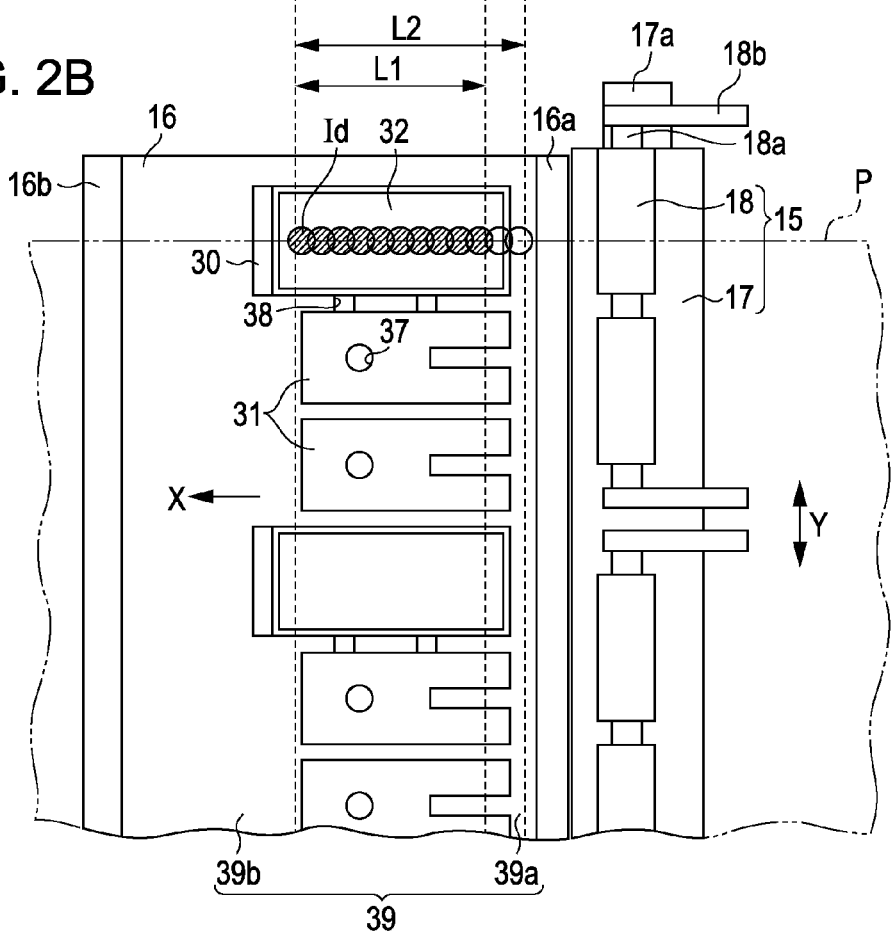
FIG. 2B is a plan view of the pair of transport rollers and the support member.

As shown in FIG. 2B, the deposit recess 30 is located on the upper surface of the support member 16 such that the upstream end portion in the transport direction X is aligned with the upstream end portion of the suction recess 31 in the transport direction X. In contrast, a downstream end portion of the deposit recess 30 in the transport direction X is located downstream of a downstream end portion of the suction recess 31 in the transport direction X, on the upper surface of the support member 16. Also, grooves 38 are provided between the deposit recess 30 and the suction recess 31, for communication therebetween.

The upper surface of the support member 16 includes a flat support region 39 located around the deposit recesses 30 and the suction recesses 31 for supporting the back surface of the paper sheet P, except for portions where the grooves 38 are provided. Here, a portion of the support region 39 upstream of the deposit recesses 30 and the suction recesses 31 in the transport direction X constitutes a support region 39*a*, and a portion of the support region 39 downstream of the deposit recesses 30 and the suction recesses 31 in the transport direction X constitutes a support region 39*b*. The paper sheet P transported by the pair of transport rollers 15 is pressed against the support region 39*a* provided upstream of the deposit recesses 30 and the suction recesses 31 in the transport direction X.

When the suction fan 35 is driven while the opening of the suction recess 31 is covered with the paper sheet P, a negative pressure is generated in the negative-pressure chamber 36, and the negative pressure acts on the suction recess 31 so as to suck the paper sheet P onto the support region 39. Thus, the suction recess 31 serves to exert an attracting force on the paper sheet P. When the suction fan 35 is driven the attracting force also acts on the deposit recess 30 through the suction recess 31 and the grooves 38. Accordingly, the end portions of the paper sheet P in the width direction Y are attracted downward and suppressed from floating upward.

An operation of the printer 11 will now be described.

The printer 11 is configured to perform a marginless recording process of performing recording over a region including the end portions of the paper sheet P in the width direction Y, and a margined recording of performing recording on the paper sheet P leaving a margin on the respective end portion in the width direction Y. In the case of performing the marginless recording process, the deposit recesses 30 serve to receive the ink that has not landed on the paper sheet P. The ink received in the deposit recess is absorbed by the absorbent 32 and then discharged through the drain path 33.

Figure 3A:
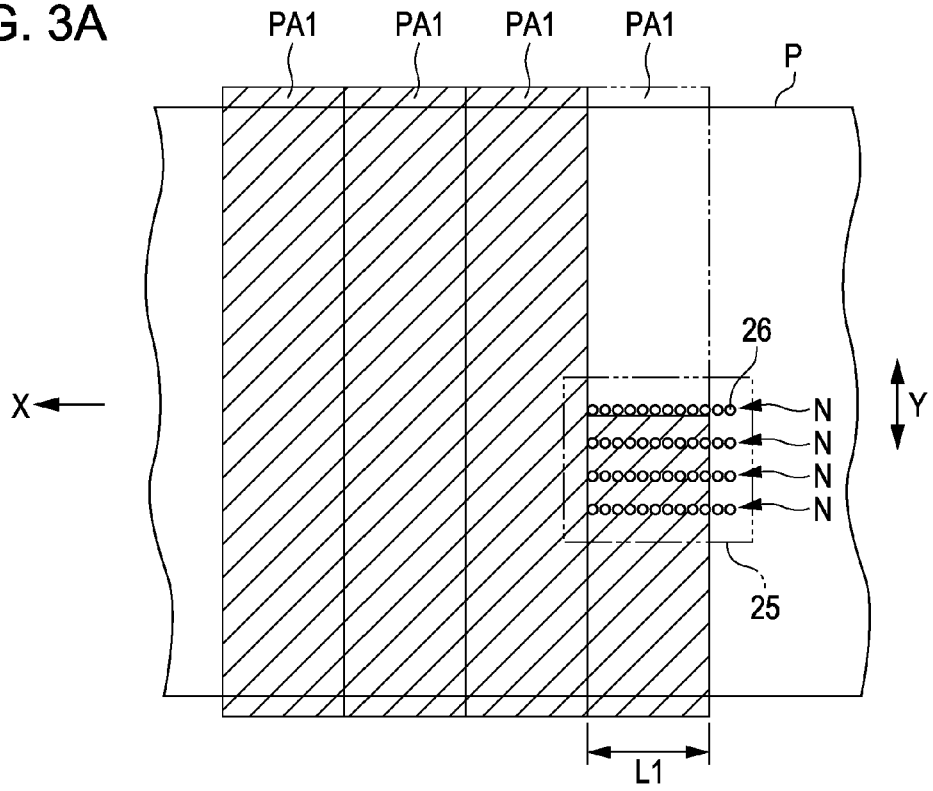
FIGS. 3A and 3B are schematic drawings for explaining a marginless recording process and a margined recording process, respectively.

In the recording head 25 of the printer 11, the most upstream of the nozzles 26 in the transport direction X are not used when performing the marginless recording process. Referring now to FIG. 3A, the recording head 25 includes a plurality of nozzle rows N (four rows in this embodiment) each including the plurality of nozzles 26, in association with the ink of the respective colors. In the case of the marginless recording process, the ink is not ejected through the most upstream of the nozzles 26 in the transport direction X constituting each of the nozzle rows N. In contrast, in the case of performing the margined recording process, all the nozzles 26 from the most upstream to the most downstream in the transport direction X are used for performing recording on the paper sheet P, as shown in FIG. 3B.

Figure 3B:
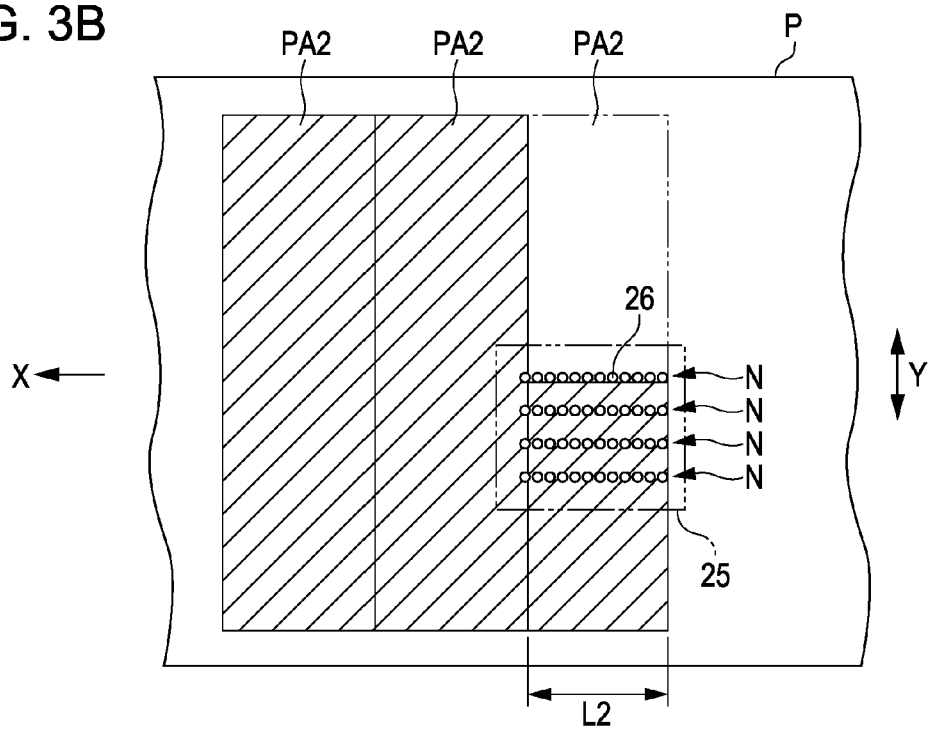

Accordingly, as shown in FIGS. 2B, 3A and 3B, a length L1 of a recording region PA1 in the transport direction X where recording is performed by a printing action executed between intermittent paper feed actions (printing path) in the marginless recording process is shorter than a length L2 of a recording region PA2 defined in the margined recording process (L1<L2). In FIG. 2B, ink droplets Id ejected from the nozzles 26 used in the marginless recording process are indicated by hatched circles, while ink droplets Id that would otherwise be ejected from the nozzles 26 unused in the marginless recording process are indicated by blank circles.

Thus, the nozzles 26 are provided in the recording head 25 as far as an upstream position of the upstream end portion of the deposit recess 30 in the transport direction X, and therefore in the case where the most upstream nozzles 26 are used in the marginless recording process, the ink droplets Id are ejected also onto the positions indicated by the blank circles in FIG. 2B, and stick to the support region 39*a*. On the contrary, since the nozzles 26 located at the positions corresponding to the support region 39*a* are not used in the marginless recording process in this embodiment, the support member 16 can be prevented from being stained in the marginless recording process.

The foregoing embodiment provides the following advantageous effects.

Since the support member 16 includes the support region 39*a* provided over the upstream region of the upstream end portion of the deposit recess 30 in the transport direction X, the paper sheet P can be supported by the support region 39*a*. Although the nozzles 26 are provided in the recording head 25 as far as an upstream position of the upstream end portion of the deposit recess 30 in the transport direction X, the most upstream nozzles 26 in the transport direction X are not used in the marginless recording process. Such a configuration allows the deposit recess 30 to be made shorter in the transport direction X by a length corresponding to the nozzles 26 that are not used in the marginless recording process. Reducing thus the length of the deposit recess 30 in the transport direction X can make the distance between the pair of transport rollers 15 and the recording region shorter, despite the support region 39*a* being provided upstream of the deposit recess 30. Consequently, the printer 11 can stabilize the alignment of the paper sheet P on the support member 16, thereby preventing degradation of recording quality.

Since the attracting force generated upon driving the suction mechanism 34 can be exerted on the deposit recess 30 through the grooves 38, a portion of the paper sheet P located on the deposit recess 30 can be properly attracted. Accordingly, the end portions of the paper sheet P on the deposit recess 30 can be suppressed from floating, and the paper sheet P can be stabilized in a vertical direction.

In the case where the support region 39*a* is not provided upstream of the suction recess 31 in the transport direction X, a portion around the center of the paper sheet P in the width direction Y may sink downward upon being pressed against the support member 16 by the pair of transport rollers 15, which may result in degradation of recording quality because of a deviated landing position of the ink droplet. On the contrary, since the upstream end portion if the deposit recess 30 in the transport direction X is aligned with the upstream end portion of the suction recess 31, the paper sheet P can be evenly supported in the width direction Y by the support region 39*a* provided upstream of the deposit recess 30 and the suction recess 31. Also, air is suppressed from flowing into the deposit recess 30 unlike in a structure in which the upstream end portion of the deposit recess 30 in the transport direction X includes a cutaway portion, and therefore the end portion of the paper sheet P in the width direction Y can be effectively attracted.

Even though the recording head 25 ejects the ink through the most downstream nozzles 26 in the transport direction X in the marginless recording process, the deposit recess 30 can receive the ink that has not landed on the paper sheet P. Also, since the support region 39 is provided around the deposit recess 30, air is suppressed from flowing into the deposit recess 30 unlike in a structure in which the upstream end portion of the deposit recess 30 in the transport direction X includes a cutaway portion, and therefore the end portion of the paper sheet P in the width direction Y can be effectively attracted.

In the margined recording process the entire ink ejected through the nozzles 26 is received by the paper sheet P, and therefore the support member 16 can be prevented from being stained despite the recording head 25 ejecting the ink through the nozzles 26 located upstream of the upstream end portion of the deposit recess 30.

The foregoing embodiment may be modified as follows.

Instead of forming the grooves 38, a communication orifice may be provided between the deposit recess 30 and the negative-pressure chamber 36 for communication therebetween, so as to directly apply the negative pressure to the deposit recess 30. In this case, the communication orifice 37 having an opening in the upper surface of the support member 16 may be utilized for attracting the paper sheet P, instead of forming the suction recess 31.

A charging mechanism for charging the support region 39 may be provided instead of the suction mechanism 34, to attract the paper sheet P to the support member 16 by an electrostatic adsorption power.

The shape, location, and number of the deposit recesses 30 and the suction recesses 31 in the width direction Y may be modified as desired.

The number of nozzles 26 and nozzle rows N (number of liquid types) may be modified as desired. Also, the number of most upstream nozzles 26 in the transport direction X unused in the marginless recording process may be determined as desired.

The paper sheet P may be transported in a direction intersecting with a horizontal direction, without limitation to the horizontal direction. Also, the support member may be formed in a different shape such as a cylindrical shape, instead of the plate shape.

Instead of paper, any desired material such as a metal, a plastic film, and a cloth may be employed as the recording medium.

The recording apparatus is not limited to a printer, and may be a facsimile machine, a copier, or a multifunction apparatus that performs a plurality of functions.

The recording apparatus may include a liquid ejecting apparatus having a liquid ejecting head that ejects a minute amount of liquid droplet other than the ink. Here, the term "liquid droplet" refers to the state of the liquid dispensed from the liquid ejecting apparatus, and examples of the liquid droplet include a droplet having a particle shape, a droplet having a teardrop shape, and a droplet having a trailing tail shape. The liquid herein referred to includes those materials that can be ejected by the liquid ejecting apparatus. For example, materials in a liquid phase may be employed such as a liquid having a high or low viscosity, a sol, a gel water, an inorganic solvent, an organic solvent, a solution, a liquid resin, a liquid metal (molten metal liquid), and also a solvent in which particles of a functional material composed of a solid substance, such as a pigment or metal particle, are dissolved, dispersed or mixed may be employed, in addition to the materials in the liquid phase. The liquid can be typically exemplified by the ink referred to in the foregoing embodiment, and a liquid crystal. Here, the ink includes a general water-based ink, oil-based ink, and a liquid composition such as a gel ink and a hot-melt ink. Examples of the liquid ejecting apparatus include those that eject a dispersion or solution of an electrode material or a color material employed for manufacturing a liquid crystal display, an electroluminescence (EL) display, a surface emission display, a color filter, and so forth, those that eject a bioorganic material employed for manufacturing a biochip, those that eject a liquid for a precision pipette that serves as a specimen, a printing machine, a micro dispenser, and so forth. Further examples of the liquid ejecting apparatus include those that eject a lubricant oil to a pinpoint in a precision apparatus such as a watch or camera, and those that eject an acid or alkali etching solution for performing an etching process on a substrate.

What is claimed is:

1. A recording apparatus comprising:

a pair of transport rollers that transport a recording medium in a transport direction;

a recording head that ejects a liquid through a plurality of nozzles arranged in a row in the transport direction to a front surface of the recording medium being transported by the pair of transport rollers, thereby performing recording on the recording medium; and a support member disposed so as to oppose the recording head, wherein the support member includes a deposit recess that receive the liquid ejected to a region deviated from the recording medium in a marginless recording process in which the recording is performed over a region including end portions of the recording medium in a width direction intersecting with the transport direction, the deposit recess being located at a position corresponding to the respective end portion of the recording medium in the width direction, and a support region being provided upstream of the deposit recess in the transport direction so as to support a back surface of the recording medium;

a suction mechanism cooperating with the support member and generating an attracting force on the recording medium through a suction recess formed in the support member and through the deposit recess; and the nozzles are arranged in a row on the recording head as far as an upstream position of an upstream end portion of the deposit recess in the transport direction, and a most upstream one of the nozzles in the transport direction is not used in the marginless recording process, wherein those nozzles of the plurality of nozzles that are located at positions corresponding to the support region are not used in the marginless recording process.

2. The recording apparatus according to claim 1, further comprising a groove communicating between the deposit recess and the suction recess.

3. The recording apparatus according to claim 2, wherein the deposit recess is formed such that the upstream end portion thereof in the transport direction is aligned with an upstream end portion of the suction recess in the transport direction, and the support region is located upstream of the suction recess in the transport direction.

4. The recording apparatus according to claim 2, wherein the deposit recess is formed such that a downstream end portion thereof in the transport direction is located downstream of a downstream end portion of the suction recess in the transport direction, and the support region is provided so as to surround the deposit recess.

5. The recording apparatus according to claim 1, wherein the recording head uses all the nozzles from the most upstream one to the most downstream one in the transport direction for performing recording on the recording medium, in a margined recording process in which recording is performed on the recording medium leaving a margin on the respective end portion thereof in the width direction.

* * * * *